United States Patent [19]

Wiener

[11] Patent Number: 4,899,473

[45] Date of Patent: Feb. 13, 1990

[54] PICTURE FRAME ASSEMBLY

[76] Inventor: Alan Wiener, 5327 Andasol Ave., Encino, Calif. 91316

[21] Appl. No.: 232,398

[22] Filed: Aug. 15, 1988

[51] Int. Cl.[4] ..... A47G 1/06; G09F 1/12

[52] U.S. Cl. ..... 40/152

[58] Field of Search ..... 40/152, 158.1, 155

[56] References Cited

U.S. PATENT DOCUMENTS

| | | | |
|---|---|---|---|
| 1,232,095 | 7/1917 | Sass | 40/152 |
| 1,765,980 | 6/1930 | Kaufman | 40/152 |
| 2,181,874 | 12/1939 | Cross | 40/152 |
| 2,811,799 | 11/1957 | Clark | 40/152 |
| 2,942,368 | 6/1960 | Gale | 40/158.1 |
| 3,237,333 | 3/1966 | Bacharach | 40/152 |
| 3,813,799 | 6/1974 | Caravello | 40/152 |

*Primary Examiner*—Cary E. Stone

*Attorney, Agent, or Firm*—John J. Posta, Jr.

[57] ABSTRACT

The picture frame assembly includes a frame of injection molded plastic, such as polyethylene, polypropylene or the like, or a laminate of injection molded plastic and film, or aluminum. The frame defines a viewing window which may be covered by a sheet of transparent glass or plastic in the frame. A backboard is used in the frame behind the window, which backboard includes an outer frame-supporting perimeter and an openable, hinged, generally central portion. When closed, the central portion also supports the frame. Preferably, the backboard comprises foldable material such as paperboard, cardboard, stiff cloth or paper, or the like, with the hinged thereof being a fold line at the base of the openable portion, the latter being defined by a cut line separating it from the perimeter. A finger hole may be provided to aid in moving the openable portion. A mask is disposed between the backboard and sheet of glass or plastic and may be a separate sheet with one or more picture openings and a masking perimeter blocking view of the finger hole, cut line and fold line. Alternatively, the mask may be silk screened on the inner surface of the glass or plastic sheet and serve the same purpose. Support inserts may be secured to the back of the frame over the backboard and optionally releasably hold a central portion closed.

10 Claims, 2 Drawing Sheets

PICTURE FRAME ASSEMBLY

BACKGROUND OF THE INVENTION

1. Field of the Invention

The present invention generally relates to picture frames and, more particularly, to a picture frame assembly of an improved type.

2. Prior Art

A picture frame is usually one into which a document, photo or picture can be placed after the frame is purchased empty and before the frame is hung on a wall or placed on a desk, shelf or the like. Wall frames are generally made with fully removable unitary backboards. The backboard must first be totally removed in order to insert the photo, document or picture in the frame, and then the backboard must be reinserted in the frame and held in place. A photo frame is similar to a wall frame, but usually includes a built-in easel and is designed to be placed on a desk top, shelf, table or the like.

Certain types of frame materials do not adapt well to removable backboards. These are aluminum frames, injection molded plastic frames and laminates of injection molded plastic and polyester film material, such as that sold under the registered U.S. Trademark MYLAR by E. I. DuPont de Nemours & Co., Wilmington, Del. Wooden frames usually employ removable staples or pins to releasably hold the backboard in place in wall frames. Wooden photo frames usually employ drop slots in the frame for removal of the backboard.

However, neither of these techniques is useful with plastic, plastic laminated and aluminum frames because of their methods of manufacture and their inherent properties. They usually require permanent backboards for structural rigidity. Accordingly, backboards for these types of frames are permanently secured in place, either by being tightly trapped under a bent rear frame lip or by being hot melt glued in place to the frame at the factory with the picture, photo or document already in place. These frames are therefore useful only for permanently framed pictures and not for wall frames and photo frames which the purchaser buys with the frame empty and then inserts the picture, document or photo himself or herself and may later remove and change the picture, document or photo.

Because aluminum frames, injection molded plastic frames and laminated combination polyester film and injection molded plastic frames are superior to wooden frames in appearance, low cost, light weight and general desirability, it would be advantageous to be able to provide such frames with removable backboards and thus enable the purchaser to insert photos, pictures and documents therein, just as in the case of wooden frames.

SUMMARY OF THE INVENTION

The improved assembly of the present invention satisfies the foregoing needs. The assembly is substantially as set forth in the Abstract of the Disclosure.

The assembly comprises a frame of aluminum, injection molded plastic or a laminate of polyester film, such as MYLAR film and injection molded plastic such as polyethylene, polypropylene or the like. The frame defines a window which may be covered by a sheet of transparent glass or plastic in the frame. The assembly includes a backboard of preferably foldable material such as paperboard, cardboard, stiff cloth, or the like having an outer frame-supporting perimeter and a generally control openable hinged portion, through which photos, pictures and documents can be inserted into the frame. The backboard may define the central portion by a cut line terminating at a fold line which acts as the integral hinge for the central portion. A finger hole to maneuver the central portion may also be included.

A mask is disposed between the backboard and glass or plastic cover in the frame. The mask can be silk screened on the front or rear surface of the transparent cover or can be a separate sheet bearing one or more openings through which to view the picture(s), photo(s) and/or document(s) in the frame. The mask covers the finger hole, cut line and fold line (if the fold line is present) of the backboard. One or more corner inserts may be secured to the rear of the frame to help hold the frame against distortion, help hold the backboard in place and/or releasably hold the central backboard portion closed.

The assembly is simple, durable, efficient, low in cost and attractive of appearance. Further features of the present invention are set forth in the following detailed description and accompanying drawings.

DRAWINGS

DETAILED DESCRIPTION

Figure 1:
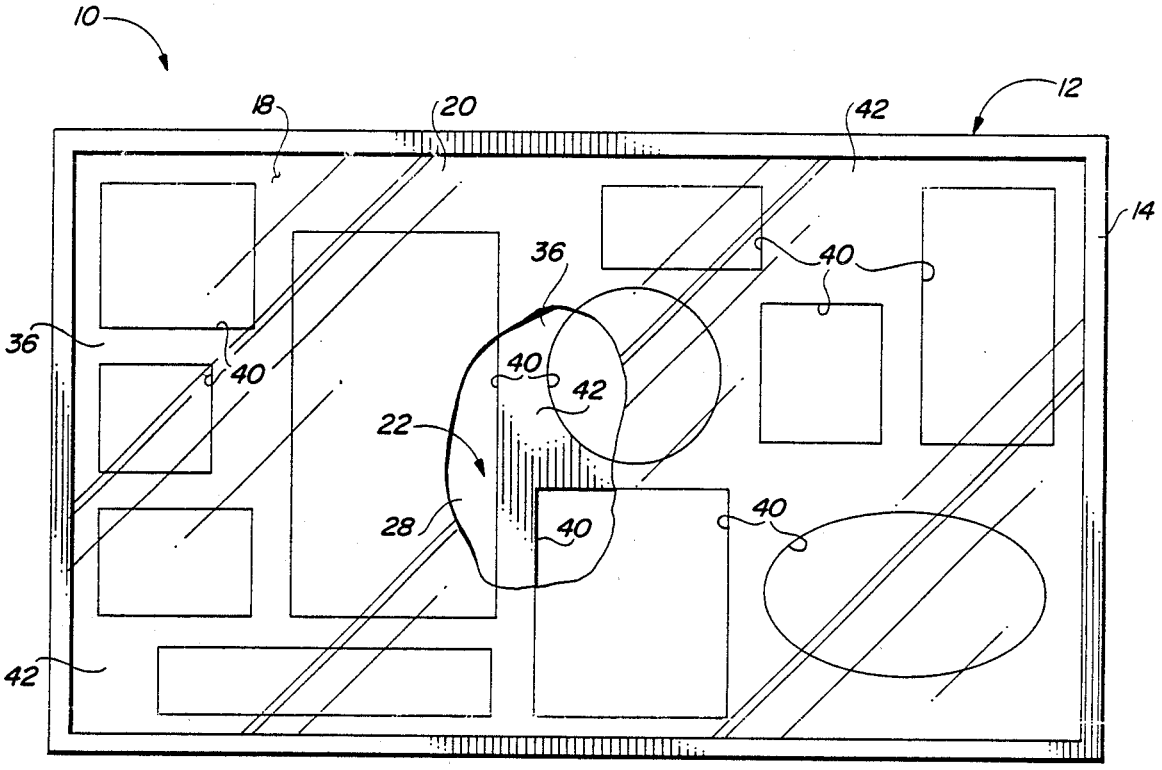
FIG. 1 is a schematic front elevation, partly broken away, of a first preferred embodiment of the improved picture frame assembly of the present invention.
Figure 2:
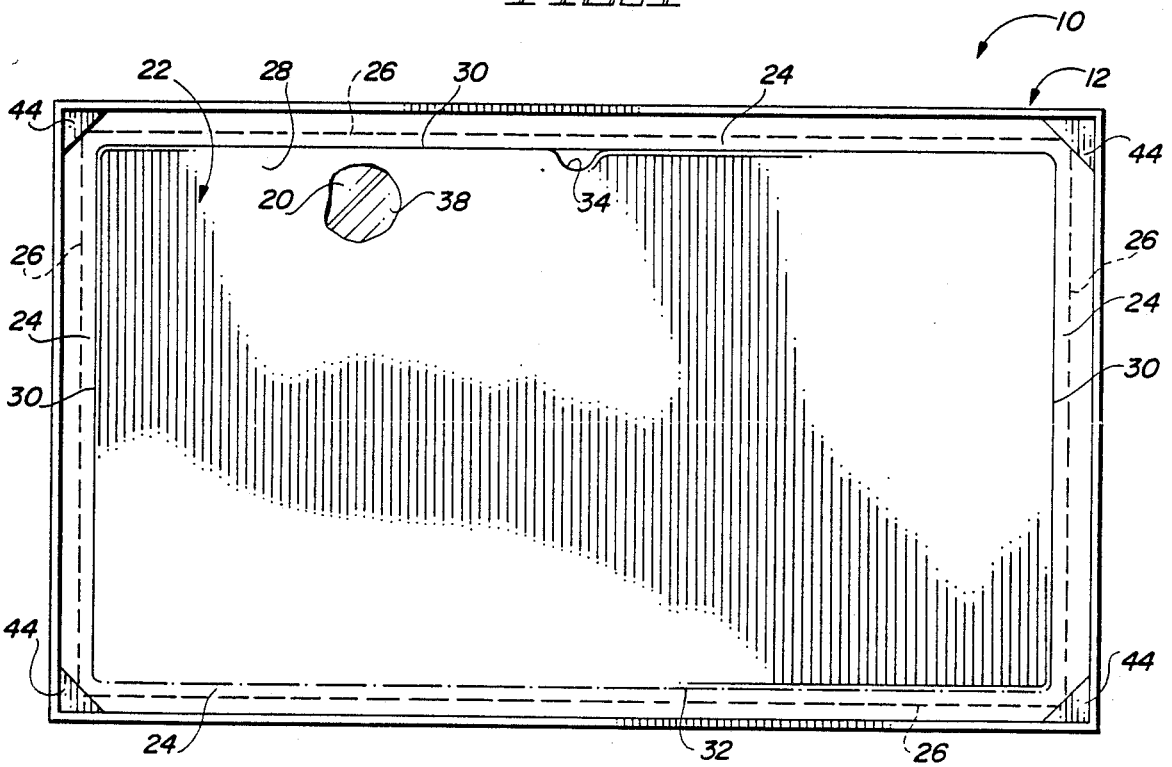
FIG. 2 is a schematic rear elevation of the assembly of FIG. 1.

FIGS. 1 and 2

Now referring more particularly to FIGS. 1 and 2 of the accompanying drawings, a first preferrred embodiment of the improved picture frame assembly of the present invention is schematically depicted therein.

Thus, assembly 10 is schematically depicted in FIGS. 1 and 2. Assembly 10 comprises a frame 12 which may, for example, be of aluminum, injection molded plastic, such as polyethylene, polypropylene or the like, or a laminate of polyester film such as MYLAR film and injection molded plastic.

In FIG. 1, frame 12 is depicted as comprising a laminate having a top surface film 14 of MYLAR brand polyester and a substrate of polyethylene plastic. Frame 12 may be any suitable shape, such as rectangular, with a central opening 18 preferably covered by a transparent sheet or cover 20 of glass or plastic held in frame 12 by an openable backboard 22.

Backboard 22 is of special construction and configuration. It can be made of any suitable foldable, self-supporting opaque material such as cardboard, pasteboard, paperboard, stiff paper, stiff cloth, etc. It includes an outer perimeter or border 24 which fits closely within the back of frame 12 and is preferably permanently secured thereto, as by glue lines 26, so that border 24 braces and supports frame 12.

Backboard 22 also includes a central portion 28 which is openable and which, when closed, helps to brace frame 12. Portion 28 is formed by cutting backboard along a cut line 30 which extends on three sides of portion 28 and terminates at a bottom horizontal fold line 32 which serves as the fourth side of portion 28 and which acts as a hinge for portion 28 to enable it to be opened and closed by the user of frame 12, as by inserting a finger tip or top finger hole 34 in portion 28 and pivoting portion 28 in the desired direction. It will be understood that portion 28 can be of any desired size and configuration.

Assembly 10 also includes an opaque mask 36 which, in this instance, is silk screened on the inner surface 38 of cover 20. Mask 36 defines a plurality of picture-viewing openings 40 surrounded by opaque areas 42, behind which openings 40 can be placed photos, pictures, documents (not shown) and the like, held in place, as by tape (not shown) running to areas 42. Alternatively, such photos, pictures and documents can be glued or taped to the front of portion 28 of backboard 22 by the user of assembly 10. Additional photos, etc., can be added, removed and substituted, as desired, because of openable portion 28. Openings 40 may be of various sizes and shapes for an attractive appearance. Mask 36 also blocks a front view of cut line 30, fold line 32 and finger hole 34 so that backboard 22 is not seen through cover 20.

Assembly 10 may also include rear frame support inserts 44 which can be glued or otherwise secured in place to frame 12 after backboard 22 is secured to frame 12. Inserts 44 can be of metal, wood, plastic or the like and can be used to hold backboard 22 in place, if desired, as well as structurally supporting frame 12 against distortion.

Assembly 10 is inexpensive, durable, attractive, and efficient. It allows photos, pictures and documents to be substituted at will in frame 12 without having to remove backboard 22 from frame 12. Backboard 22 acts as a structural brace for frame 12, as well as convenient access means for the photos, pictures, documents, etc.

Figure 3:
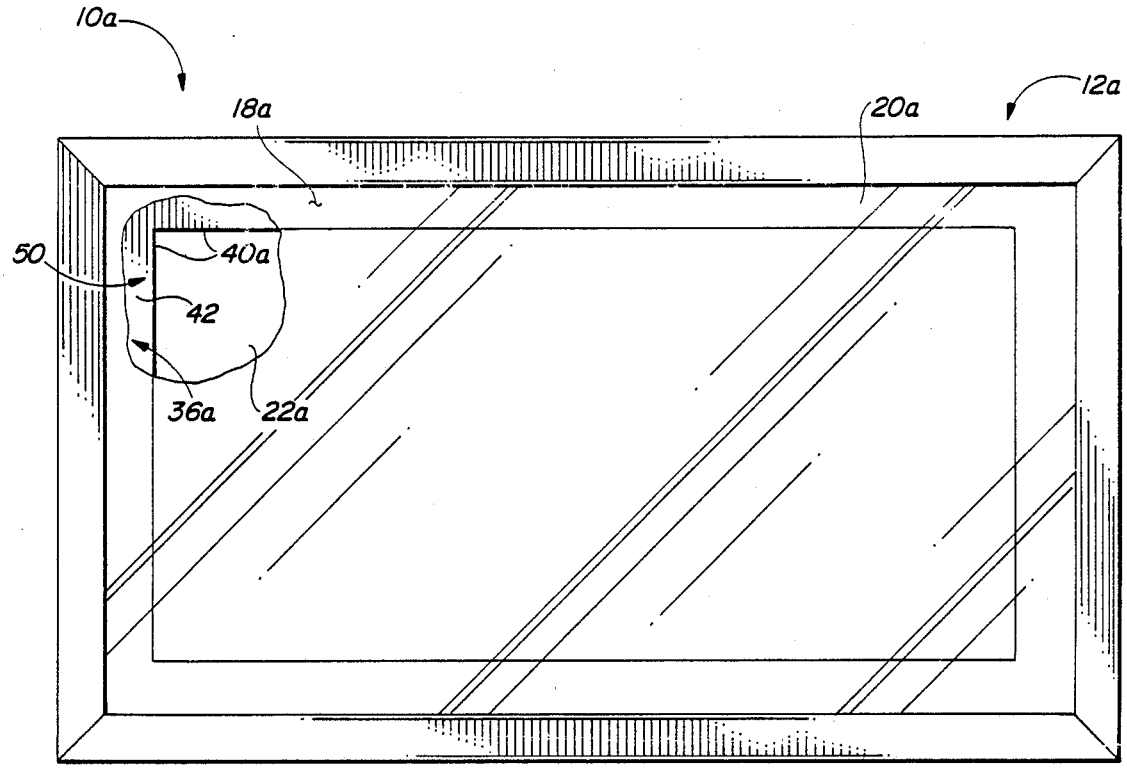
FIG. 3 is a schematic front elevation of a second preferred embodiment of the improved picture frame assembly of the present invention; and, FIG. 4 is a schematic rear elevation of the assembly of FIG. 3.
Figure 4:
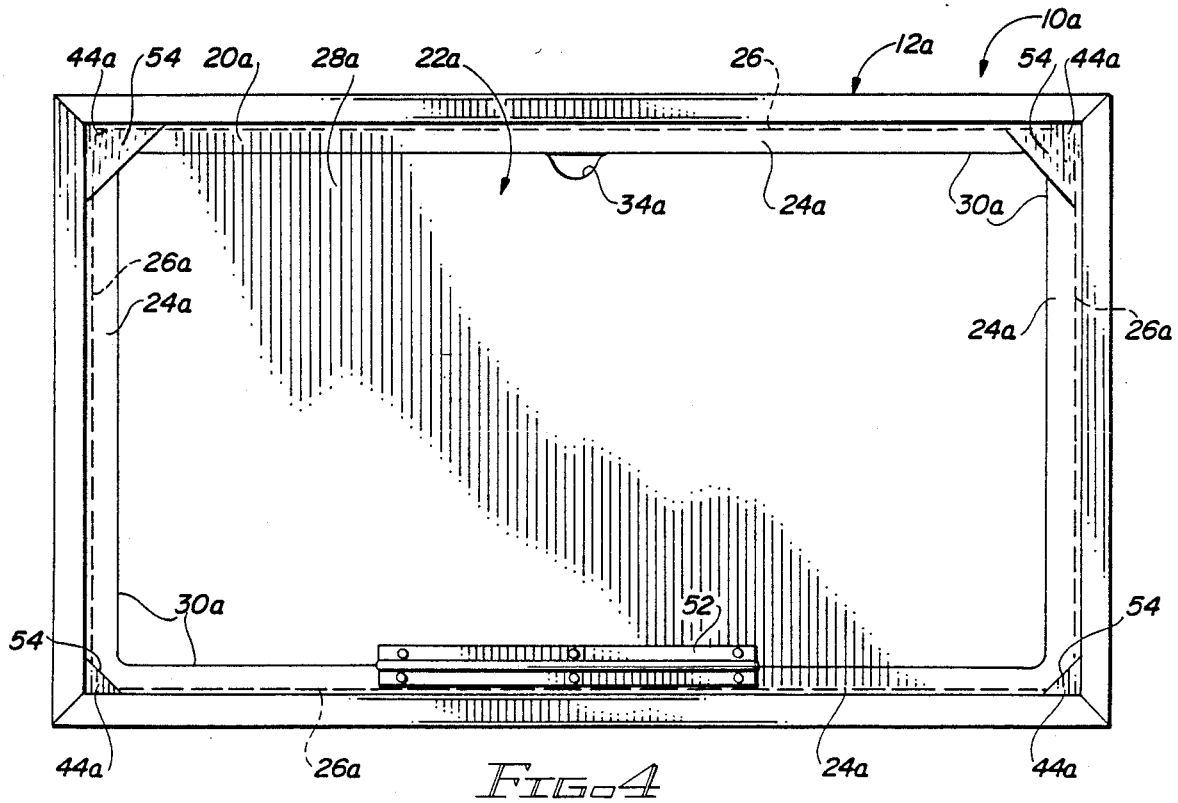

FIGS. 3 and 4

A second preferred embodiment of the improved picture frame assembly of the present invention is schematically depicted in FIGS. 3 and 4. Thus, assembly 10*a* is shown. Components thereof similar to those of assembly 10 bear the same numerals but are succeeded by the letter "a".

Assembly 10*a* is substantially identical to assembly 10, except as follows:

(a) mask 36*a* comprises an opaque sheet 50 of paper, cardboard, paperboard or the like placed behind glass cover 20*a* and in front of backboard 22*a* in frame 12*a;* sheet 50 has a single central opening 40*a;*

(b) frame 12*a* is of injection molded plastic rather than a laminate;

(c) backboard 22*a* can be of wood, metal, plastic, paperboard, cardboard or the like and has no fold line; instead, it has a separate hinge 52 secured to openable central portion 28*a* and to outer border 24*a* of backboard 22*a,* as by glue or the like (not shown); and, (d) the top ones of inserts 44*a* are dimensioned to frictionally contact and releasably trap the top side margins of central portion 28*a* at points 54 to help hold it closed.

Assembly 10*a* has the other features and advantages of assembly 10.

Various other modifications, changes, alterations and additions can be made in the improved assembly of the present invention, its components and their parameters. All such modifications, changes, alterations and additions as are within the scope of the appended claims form part of the present invention.

What is claimed is:

1. An improved picture frame assembly, said assembly comprising, in combination:

(a) a frame defining a viewing window, (b) a backboard having a frame-supporting outer perimeter area disposed within and secured to said frame, said backboard lying within a plane located between the front and back surface planes of said frame, and an openable generally central portion bearing a hinge, said central portion permitting insertion of pictures therethrough without removing said backboard from within said frame, said central portion abutting said perimeter in a line; and, (c) a mask having a picture opening and a masking perimeter, said mask being between said backboard and said window, said masking perimeter masking said backboard abutting line and said hinge wherein said assembly includes support inserts affixed to the back of said frame at each corner which releasably retain the corners of said central portion of said backboard in a closed position.

2. The improved assembly of claim 1 wherein said frame consisting of ar least one of injection molded plastic, a laminate of injection molded plastic and polyester film, and aluminum.

3. The improved assembly of claim 2 wherein said assembly includes a transparent self-supporting sheet covering said window in said frame.

4. The improved assembly of claim 3 wherein said central portion of said backboard includes a finger hole for opening said central portion, wherein said backboard is foldable material, and wherein said hinge comprises a fold line in said backboard at the bottom of said central portion.

5. The improved assembly of claim 5 wherein said transparent sheet is one of glass and plastic and said backboard consists of one of cardboard, paperboard, and stiff cloth.

6. The improved assembly of claim 3 wherein said mask is silk screened on the inner face of said transparent sheet.

7. The improved assembly of claim 6 wherein said mask has a plurality of spaced picture-viewing openings separated by opaque masked areas.

8. The improved assembly of claim 3 wherein said mask comprises a separate sheet disposed behind said transparent sheet and in front of said backboard.

9. The improved assembly of claim 1 wherein said backboard hinge is separately connected to and not part of said backboard.

10. The improved assembly of claim 1 wherein said central portion and said support inserts are dimensioned and aligned such that at least some of said support inserts releasably hold said central portion in a closed position.

* * * * *